US009656827B2

(12) United States Patent
Sudhir

(10) Patent No.: US 9,656,827 B2
(45) Date of Patent: May 23, 2017

(54) PORTABLE AND DETACHABLE DISPENSER

(76) Inventor: Sanandan Sudhir, Delhi (IN)

( * ) Notice: Subject to any disclaimer, the term of this patent is extended or adjusted under 35 U.S.C. 154(b) by 474 days.

(21) Appl. No.: 13/514,983

(22) PCT Filed: Nov. 16, 2010

(86) PCT No.: PCT/IN2010/000747
§ 371 (c)(1),
(2), (4) Date: Oct. 26, 2012

(87) PCT Pub. No.: WO2011/070587
PCT Pub. Date: Jun. 16, 2011

(65) Prior Publication Data

US 2013/0048775 A1 Feb. 28, 2013

(30) Foreign Application Priority Data

Dec. 11, 2009 (IN) ..... 2577/DEL/2009

(51) Int. Cl.
*B65H 35/00* (2006.01)
*B65H 23/08* (2006.01)

(52) U.S. Cl.
CPC ..... *B65H 35/0026* (2013.01); *B65H 23/08* (2013.01); *B65H 35/0006* (2013.01); *B65H 35/0073* (2013.01)

(58) Field of Classification Search
CPC B65H 35/0026; B65H 23/08; B65H 35/0006; A47K 10/38
USPC ... 242/422.5, 396.6, 588, 588.1, 588.2, 566, 242/400, 402; 225/56–66
See application file for complete search history.

(56) References Cited

U.S. PATENT DOCUMENTS

| | | | | | |
|---|---|---|---|---|---|
| 381,294 | A | * | 4/1888 | Tea | 242/422.5 |
| 424,493 | A | * | 4/1890 | Morris | 281/13 |
| 549,672 | A | * | 11/1895 | Jewell | 242/422.5 |
| 1,296,117 | A | * | 3/1919 | Pierce et al. | 53/204 |
| 2,588,043 | A | * | 3/1952 | Rabinowitz et al. | 30/359 |
| 2,655,214 | A | * | 10/1953 | Van Cleef | B65H 35/008 225/65 |
| 2,703,208 | A | * | 3/1955 | Tasker | 225/6 |
| 2,704,190 | A | * | 3/1955 | Schmale et al. | 242/406 |
| 2,706,003 | A | * | 4/1955 | Isler | 225/22 |
| 2,788,181 | A | * | 4/1957 | Anderson | B65H 35/0026 225/65 |
| 3,149,764 | A | * | 9/1964 | Waltz | 225/57 |

(Continued)

*Primary Examiner* — Emmanuel M Marcelo
*Assistant Examiner* — Michael Gallion
(74) *Attorney, Agent, or Firm* — D'Ambrosio & Menon, PLLC; Usha Menon

(57) ABSTRACT

The present invention discloses a portable and detachable dispenser. The dispenser of the present invention comprise a base portion which is lodged in the inner circumference part of the roll and provides an anchoring support to the dispenser, and a top portion that essentially lies over and above the outer circumference of the roll to allow the free end of the reeled product to pass through it and rest on a raised area which comprises of a cutting means. Further, the dispenser of the present invention, in its construction and placement on the roll, provides a unique locking mechanism that keeps it securely placed even with a diminishing diameter of the roll. Lastly, the dispenser of the present invention is easier to lodge and dislodge from the roll and is much lighter and convenient to use.

5 Claims, 2 Drawing Sheets

(56) References Cited

U.S. PATENT DOCUMENTS 3,283,977 A * 11/1966 Schluchter ..... B65H 35/008 225/65
3,378,184 A * 4/1968 Mallory ..... 225/66
3,556,367 A * 1/1971 Ikeda ..... B65H 35/0026 225/65
3,684,141 A * 8/1972 Hall ..... B65H 35/002 225/65
3,696,980 A * 10/1972 Waltz ..... 225/66
3,968,915 A * 7/1976 Schleicher ..... 225/65
4,093,138 A * 6/1978 Shafer ..... 242/422.5
4,194,658 A * 3/1980 Tschudin ..... 225/65
4,405,068 A * 9/1983 Blair ..... 225/65
4,606,485 A * 8/1986 Rankin ..... 225/78
4,667,891 A * 5/1987 Pool ..... 242/422.5
4,711,384 A * 12/1987 Harris ..... 225/66
D308,891 S * 6/1990 Harris ..... D19/69
5,071,051 A * 12/1991 Corbo et al. ..... 225/65
5,551,646 A * 9/1996 Goldstein ..... 242/419
5,636,809 A * 6/1997 Koch ..... 242/422.5
5,706,993 A * 1/1998 DeMatteis ..... B26F 3/002 225/106
5,759,342 A * 6/1998 Luhman et al. ..... 156/577
5,775,624 A * 7/1998 Huerta ..... 242/422.6
5,788,807 A * 8/1998 Gratz ..... B65H 35/0026 156/577
5,868,893 A * 2/1999 Kipper et al. ..... 156/277
5,934,535 A * 8/1999 Kannankeril et al. ..... 225/106
6,257,298 B1 * 7/2001 Huang ..... 156/577
6,279,806 B1 * 8/2001 Simhaee ..... 225/106
6,561,403 B1 * 5/2003 Kannankeril et al. ..... 225/96
6,648,265 B2 * 11/2003 Goldberg ..... 242/422.5
7,387,275 B1 * 6/2008 Hui ..... 242/588.3
7,841,498 B1 * 11/2010 Rohrer ..... B65H 35/0026 225/56
8,443,862 B1 * 5/2013 Manabat ..... 156/579
8,991,674 B2 * 3/2015 Lee ..... B65H 35/0033 156/250
2002/0170937 A1 * 11/2002 Yeh et al. ..... 225/39
2006/0219748 A1 * 10/2006 Thompson et al. ..... 225/16
2008/0041908 A1 * 2/2008 Daniels ..... 225/93
2008/0135181 A1 * 6/2008 Lee ..... 156/530
2009/0302084 A1 * 12/2009 Liu ..... B65H 35/0026 225/77
2010/0193539 A1 * 8/2010 Fathi ..... 221/45
2011/0073629 A1 * 3/2011 Tseng ..... 225/51
2014/0144966 A1 * 5/2014 Tan ..... 225/47
2014/0209651 A1 * 7/2014 Wilfong ..... 225/93

* cited by examiner

PORTABLE AND DETACHABLE DISPENSER

FIELD OF INVENTION

The present invention relates to a portable and detachable dispenser for reeled products. More specifically, the invention relates to a detachable dispenser with structural features to keep it in a secured position on a reeled product such as tape, wrapping paper, and aluminium foils even with a diminishing length of the reel.

BACKGROUND OF THE INVENTION

Reeled products such as adhesive tapes, aluminium foils, and toilet papers, pose a unique trouble while they are dispensed from their roll. By virtue of being packed in a rolled manner, dispensing them becomes a tedious task as far as locating the ends or tearing them for customized use is concerned. Typical dispensers such as tape dispensers address this issue by having a cutting edge that facilitates tearing of the tape at the desired length. Even though, this arrangement is convenient, many of such dispensers do not have the facility to prevent spontaneous reattachment of the tape end back to the reel whereby re-locating the end is often difficult.

These dispensers are further heavy or bulky, being much larger than the roll they accommodate. These devices are mostly designed as table top devices. Attempts have been made to provide a dispenser for holding a reel so that it is easy to tear the reel and still retain its end separated from the roll. These attempts were not highly successful particularly because such an arrangement would have required different dispensers for each size of the reel.

Use of clip dispensers has largely negated the bulkiness aspect associated with traditional dispensers, but the problem with a typical clip dispenser is that they cannot provide constant and positive holding force with the decreasing thickness of the reel layers. It is further noticed that when the size of the reel is minimum the clips of the dispenser runs the risk of being released from the crust of the reel. It is further noticed that such dispensers will tear and deform the edges of the sides of the reel while the dispenser slides through the reel.

U.S. Pat. No. 4,496,276 discloses a compact tape shear which is a plastic material that is transversely strapped around the tape roll and its core. The shear comprises a locking tongue and a cutting edge. However, the holding force provided by the shear of the '276 patent decreases with the decreasing thickness of tape layers, resulting in loss of stability. This eventually translates into an un-effective functioning of cutting edge and hence the shear.

U.S. Pat. No. 5,634,580 disclose a tape dispenser which is held in position by engaging the sides of the tape roll only. The '580 patent specifically discuss the dispenser having two flank sections located on either sides and these flanks are clipped onto the reeled tape in a radial direction. However, the '580 patent does not provide answers to the issues of loosing the holding forces with decreasing the thickness of the reel. The design of the dispenser of the '580 patent also pose a risk of the dispenser getting detached from the tape while tearing the tape.

The portable dispensers of the existing art though addressed the issue of size and weight but failed miserably in providing a stable and convenient-to-use dispenser that could withstand the diminishing size of roll thickness without the risk of getting dislodged from the roll. Further, with a blade/cutting means as an inherent part and an associated risk of getting dislodged make the dispensers of the existing art inappropriate for use by children and disabled persons.

It is, therefore, a need in the art to create a portable and detachable dispenser that, apart from providing a uniform cutting and reel locating means, must also provide a constant and positive holding force at all stages and all thicknesses of the reel. A dispenser of such a nature must not be dislodged at any instance unless specifically pulled out of the reel. Further, such a dispenser must be light weight and convenient to use to make it suitable for use by children and disabled persons.

OBJECTS OF THE INVENTION

It is an object of the invention to provide portable and detachable dispenser for reeled products.

It is an object of the invention to a compact, portable, and easy-to-use dispenser for reeled products.

It is an object of the invention to provide a dispenser that provides constant and uniform holding force to keep the dispenser on the roll even with diminished diameter of the roll.

It is another object of the invention to provide a stable dispenser that does not fall off the roll at any stage of use.

It is an object of the invention to provide a dispenser having slidable movement during its working.

It is an object of the invention to provide a dispenser enabling easy relocation of a cut reel end of the reeled product.

It is an object of the invention to provide a dispenser having a simple construction and light weight.

SUMMARY OF THE INVENTION

The present invention discloses a portable and detachable dispenser. The dispenser of the present invention comprise a base portion which is lodged in the inner circumference part of the roll and provides an anchoring support to the dispenser, and a top portion that essentially lies over and above the outer circumference of the roll to allow the free end of the reeled product to pass through it and rest on a raised area which comprises of a cutting means. Further, the dispenser of the present invention, in its construction and placement on the roll, provides a unique locking mechanism that keeps it securely placed even with a diminishing diameter of the roll. Lastly, the dispenser of the present invention is easier to lodge and dislodge from the roll and is much lighter and convenient to use.

DETAILED DESCRIPTION OF THE INVENTION

Figure 1:
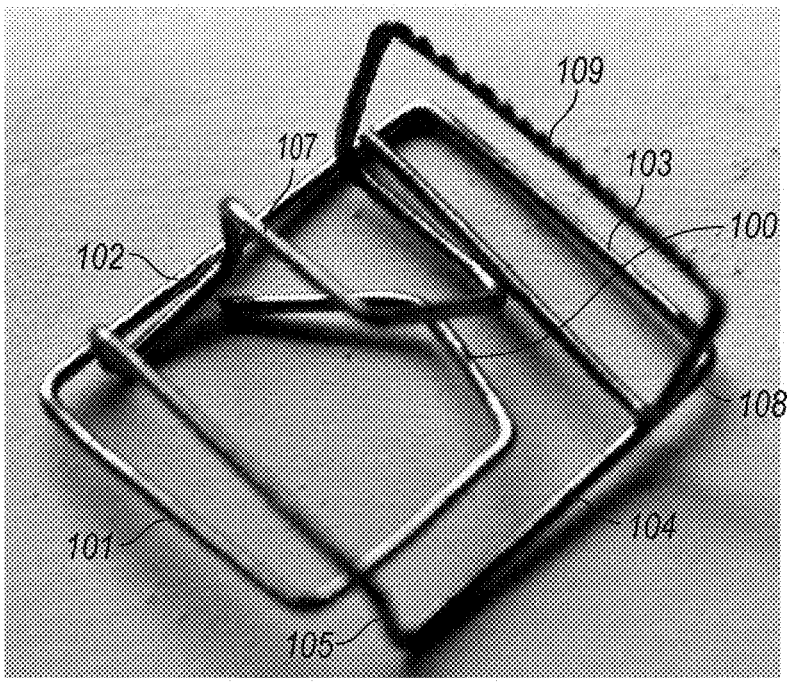
FIG. 1 is a perspective view of the dispenser according to the invention.

A perspective view of a preferred embodiment of the portable and detachable dispenser according to the invention is shown in FIG. 1. In an embodiment, the dispenser is made of strong steel/iron or other metallic or non-metallic substance that can be configured to provide tension and strength. The metallic/non metallic rod/wire can be uniquely shaped and curved to provide adequate tension and holding force while mounted on a reel.

Figure 2:
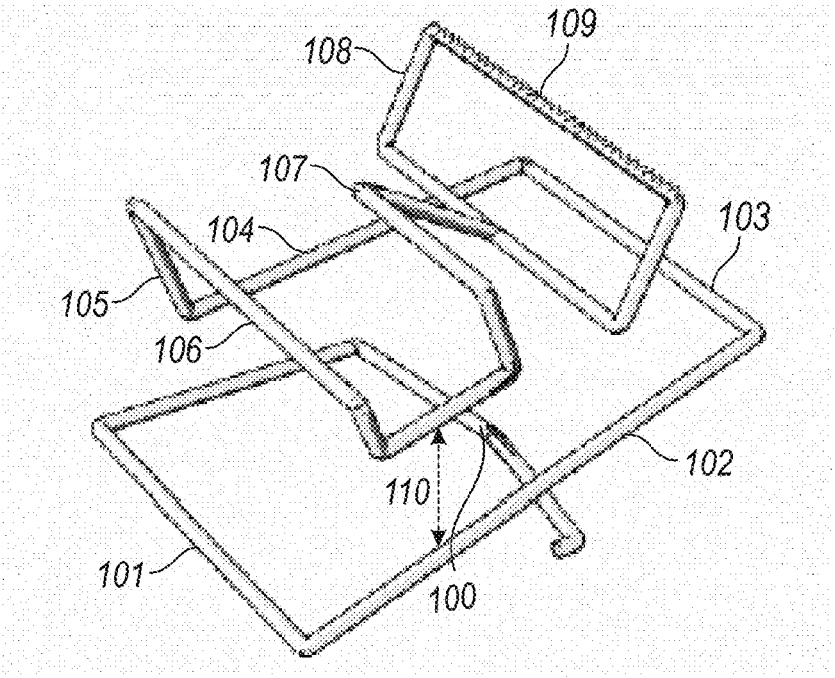
FIG. 2 is an enlarged perspective view of FIG. 1 in a stretched, working posture which clearly distinguishes each features of the embodiment.

As illustrated in FIGS. 1 & 2, in a preferred embodiment, the dispenser of the present invention comprises a base portion and a top portion. The base portion is adapted to attach to the inner circumference of the roll (not shown in the figure) in a manner so as to exert an upward force on the roll, sufficient enough to hold it with the dispenser. The top portion is adapted to attach to the outer circumference of the roll (not shown in the figure) so as to provide a raised portion for the loose end of the reeled product to rest.

In an embodiment, the base portion comprises a first horizontal portion 100, a second horizontal portion 101, a first major flanking portion 102, a third horizontal portion 103, and a second major flanking portion 104. The first horizontal portion 100 passes underneath the roll, crossing the breadth of the inner circumference of the roll and curving in a rectangular fashion to form the second horizontal portion 101. The second horizontal portion 101, thus, lies parallel to the first horizontal portion 100 separated by a distance that is sufficient enough to provide a strong grip to the dispenser over the roll. The first major flanking portion 102 is a vertical slanting portion that follows the second horizontal portion 101. The first major flanking portion 102 is positioned to flank the roll on the side so as to not allow the dispenser fall sideways. It also holds the reeled product from slipping on the sides of the dispenser. A second major flanking portion 104 lies on the other side of the roll and serves the same function. The first and the second major flanking portion are joined by the third horizontal portion 103. In a preferred embodiment, the third horizontal portion 103 is adapted to transverse the breadth of the outer circumference of the roll.

In another embodiment, the base portion comprises a slightly hooked portion towards the loose end. The hooked end portion is designed to attach itself to the inner circumference of the roll and provide an anchor like support to the dispenser. In terms of its construction and placement on the roll, the base portion is designed to hold the dispenser strongly with the bottom of the roll with uniform force, irrespective of the roll size and thickness.

In an embodiment, the top portion comprises a first upwardly facing portion adapted to allow the reeled product to pass under it and a second upwardly facing portion adapted to rest the free end of the reeled product. In another preferred embodiment, the first upwardly facing portion comprises a first vertical portion 105, and a fourth horizontal portion 106. In a preferred embodiment, the first upwardly facing portion comprises of a resting portion 107. The first vertical portion 105 allows the top portion to position itself above the outer circumference of the roll. The fourth horizontal portion 106 thus passes over and above the breadth of the outer circumference and enables the free end of the reeled product to pass under it (to be discussed below). In its construction and placement, the fourth horizontal portion 106 provides a downward force holding the reeled product in a tight position and facilitates an easy slide for the reeled product during the use of the dispenser.

The resting portion 107 is a raised area over which the free end of the reeled product passes. The benefit of the resting portion 107 is that it prevents the free end of the reeled product from getting adhered to the roll again.

In another embodiment, the second upwardly facing portion, which is an extension of the first upwardly facing portion, is a rectangular portion comprising a second vertical portion 108 and a fifth horizontal portion 109. The second vertical portion 108 allows the dispenser to remain in an elevated state thus keeping the fifth horizontal portion 109 above the outer circumference of the roll. The free end of the reeled product is finally rested on the fifth horizontal portion 109. In a preferred embodiment, the outer surface of the fifth horizontal portion 109 has a cutting means for the reeled product. In an embodiment, the cutting means can include a corrugated surface. The corrugation also serves to hold the reeled product in a convenient manner making it easier for a user to lift the free end when in need.

Figure 3:
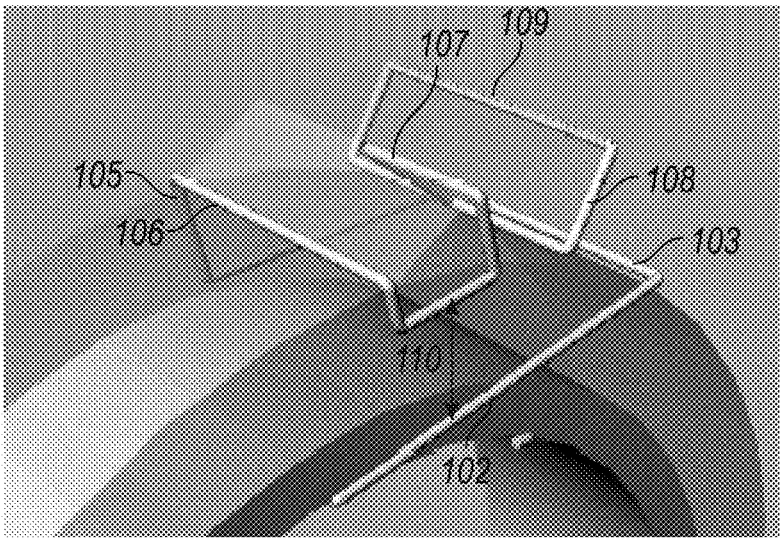
FIG. 3 is a perspective view of the dispensers according to the invention as clipped to a tape reel.
Figure 4:
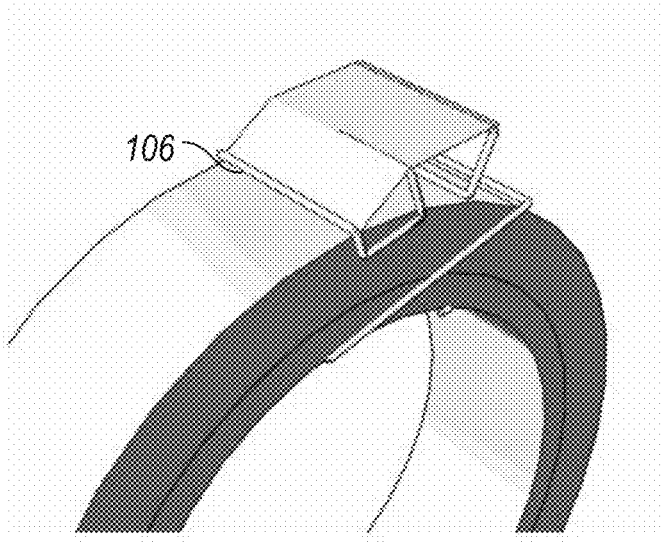
FIG. 4 is a side view of the dispenser attached to the tape reel.

FIG. 3 illustrates a working position for the dispenser in accordance to an embodiment of the present invention. In an embodiment, the roll is a tape roll with an inner circumference, an outer circumference and a free end. The dispenser is lodged into the roll by longitudinally sliding the dispenser along the roll and placing the slightly hooked portion of the base portion at outer end of the inner circumference. After securing the slightly hooked portion at its place, the dispenser can be pulled up from fourth horizontal portion 106 and slided sideways onto the roll to fit the sides of the roll at space 110. In yet another embodiment, free end of the roll is identified and the dispenser is slided through the roll till the dispenser reaches the area near the free end. The free end is then pulled through from under the fourth horizontal portion 106 (as is illustrated in FIG. 4) and passed over the resting portion 107 to finally rest the free end on the fifth horizontal portion 109. At each occasion when the tape has to be used, the free end is lifted from the fifth horizontal portion 109 and pulled for a desired length. The free end is finally cut using the corrugated surface of the fifth horizontal portion 109. As the roll is used, the dispenser is slided in a direction opposite of the tape movement. The space 110 is accordingly diminished as the dispenser moves along the roll 10.

The unique arrangement of the base portion and the top portion B and the flexible grip that is maintained at the space 110 provides the necessary locking feature that prevents the dispenser from falling off the roll at any instance of its use. When slided over the roll during its use, the grip of the dispenser is maintained throughout. When the reeled product ends, the space 110 is still maintained on the cardboard that is the base material for the roll 10. Once detached from the roll 10, the space 110 collapses and the dispenser returns to its non-working state as illustrated in FIG. 1.

To dislodge the dispenser from the roll, the free end is lifted gently from the fifth horizontal portion 109 and marked for future purpose. The slightly hooked region of the base portion of the dispenser present at the inner circumference of the roll is loosened to loose the grip of the dispenser over the roll. The dispenser is then slided longitudinally and taken out.

Advantages of the Invention

The dispenser of the present invention is portable and detachable.

The dispenser of the present invention is compact, portable, and easy-to-use.

The dispenser of the present invention provides constant and uniform holding force to keep the dispenser on the roll even with diminished diameter of the roll.

The dispenser of the present invention provides a stable dispenser that does not fall off the roll at any stage of use.

The dispenser of the present invention provides a slidable movement during its working.

The dispenser of the present invention has a simple construction and light weight.

I claim:

1. A portable and detachable reeled product dispenser comprising, a base portion adapted to attach to inner circumference of said reeled product at a second horizontal portion that is configured on one end of the product and adapted to attach to outer circumference of said reeled product at a third horizontal portion that is configured on diametrically other end of the product, said second horizontal portion and said third horizontal portion connected through flanking portion on only one side along of said reeled product, wherein the flanking portion extends from inner circumference of the reeled product to the outer circumference of the reeled product, wherein said base portion is configured to hold said dispenser with uniform force irrespective of thickness of said reeled product, wherein said base portion further comprises a first horizontal portion attached to said second horizontal portion of said reeled product; and a top portion adapted to lie above said outer circumference of said reeled product and directly above the base portion, wherein said top portion is connected with said third horizontal portion of said base portion, wherein said top portion comprises a first upwardly facing portion adapted to allow a free end of said reeled product to pass under it and a second upwardly facing portion adapted to rest said free end of said reeled product, further wherein said top portion further comprises of an upwardly facing raised portion between said first upwardly facing portion and said second upwardly facing portion over which a free end of said reeled product passes, wherein as said reeled product is used, said dispenser is slided in a direction opposite to movement of said reeled product, further wherein said second upwardly facing portion comprises of a cutting means, and wherein the second upwardly facing portion and the upwardly facing raised portion are horizontal portions that are parallel to each other, wherein said reeled product is automatically flexible and collapsible, wherein a distance between the top portion and the base portion is flexible, and wherein the top portion and the base portion move relative to each other such that the distance between the top portion and the base portion decreases as the dispenser moves along the reeled product, wherein the reeled product is devoid of a roller, and wherein the first horizontal portion and the second horizontal portion engage the inner circumference, and wherein the reeled product dispenser is made of a single wire.

2. The reeled product dispenser as claimed in claim 1, further wherein said cutting means comprises a corrugated surface.

3. The reeled product dispenser as claimed in claim 1, further wherein said dispenser is lodged and dislodged over said reeled product by longitudinally sliding said dispenser over said reeled product.

4. The reeled product dispenser as claimed in claim 1, further wherein said dispenser is flexible, collapsible, and maintains its position on said reeled product despite diminishing thickness of said reeled product.

5. The reeled product dispenser as claimed in claim 1, further wherein said dispenser is used to dispense said reeled products comprising of tapes, tissue rolls, metal foils.

* * * * *